United States Patent [19]

Weil

[11] Patent Number: 4,557,966

[45] Date of Patent: Dec. 10, 1985

[54] FERROUS METAL CORROSION INHIBITING SHEET MATERIAL

[75] Inventor: David M. Weil, Chicago, Ill.

[73] Assignee: The Cromwell Paper Company, Chicago, Ill.

[21] Appl. No.: 597,711

[22] Filed: Apr. 6, 1984

[51] Int. Cl.[4] ..... B32B 3/14; B32B 5/16

[52] U.S. Cl. ..... 428/209; 252/387; 252/394; 428/211; 428/457

[58] Field of Search ..... 428/211, 342, 457, 209; 252/387, 394

[56] References Cited

U.S. PATENT DOCUMENTS 2,739,872 3/1956 Senkus ..... 428/342

3,007,767 11/1961 Bolt et al. ..... 428/211

*Primary Examiner*—Thomas J. Herbert

*Attorney, Agent, or Firm*—Charles W. Rummler

[57] ABSTRACT

An improved sheet material for corrosion inhibition of the surfaces of packaged ferrous metal products which comprises a sheet material substrate having a vapor phase corrosion inhibitor composition applied as a printed pattern of uniformly distributed spaced - areas of predetermined size occupying about 25% of the total area of the treated sheet and consisting of a total dried weight of about 0.226 to 0.302 grams of the inhibitor composition per square foot of the treated sheet.

4 Claims, No Drawings

FERROUS METAL CORROSION INHIBITING SHEET MATERIAL

BACKGROUND OF THE INVENTION

For about thirty years, chemically treated sheet materials have been used in one way or another to protect metal surfaces against corrosion and for this purpose corrosion inhibiting material has generally been a composition which works by releasing a vapor which engages the metal surface and inhibits the corrosion effect of any moisture vapor that may be in the surrounding air. Various corrosion inhibiting compositions have been employed successfully and apparently each manufacturer of a product for this use has his own formulation and manner of application. Almost all, however, have settled upon an inhibitor loading factor of about 10 to 20 pounds, dried weight, per 3,000 square feet of the treated sheet material, or, expressed in another way, about 1.512 to 3.024 grams per square foot. The inhibiting material is applied to the substrate in various ways such as coating, spraying, saturating, or by printing, such as is described in U.S. Pat. Nos. 2,739,872 and 3,007,767. Recently the U.S. Department of the Navy MIL P-3420 Qualifying Test Program has listed as acceptable Type I, Class 3, Style A corrosion inhibitor sheet material for medium duty service, products of various manufacturers carrying corrosion inhibitor compositions in amounts ranging from about 1.512 to 3.024 grams, dry weight, per square foot of sheet area.

The research department of applicant's company developed a ferrous metal corrosion inhibitor consisting of 15 parts Urea, 15 parts Sodium Nitrite, 10 parts Sodium Benzoate and 60 parts water which, when used in the conventional loading of 3.024 grams per square foot on 40 pound natural kraft, was found to pass all qualifying tests of the Department of the Navy and is listed on the MIL 3420E Qualified Product List as a Type I, Class 3, Style A corrosion inhibitor.

In connection with efforts to determine how the vapors of conventional vapor phase inhibitors (VCI) function to prevent oxidation of ferrous metal surfaces, applicant suggested that the new corrosion inhibitor composition be tested in the usual manner with 40 pound kraft spaced area—printed with a loading of only 10% to 20% of the conventional loading amount. Accordingly a production run of material as so specified was made and successive in-house corrosion inhibition tests appeared to be so successful that this material, which was determined to have an inhibitor load factor of 0.272 grams per square foot, was submitted to a professional testing laboratory and to the U.S. Navy Department for testing according to military standards and each of these organizations found that this new product passed all MIL P-3420 Qualifying Tests. As a result, this new product is now listed as a MIL P-3420 E Type I, Class 3, Style A corrosion inhibitor.

In view of the foregoing statement, it is believed that applicant's off-hand suggestion has resulted in a discovery that is a material advance in this already crowded art, particularly in that the new product results in a considerable saving of cost in the manufacture of ferrous metal corrosion inhibiting products.

SUMMARY OF THE INVENTION

The inventive concept involved in the invention herein disclosed was the thought that a 40 pound natural kraft having an inhibitor loading of only about 10% to 20% of the conventional amount, using the newly developed inhibitor formation, and tested in various ways according to the usual in-house corrosion inhibitor testing procedures would lead to some explanation of the manner in which the vapors of vapor phase inhibitors (VCI) function to prevent, or at least inhibit, ferrous metal corrosion. This investigation resulted in the discovery that a sheet loading of 0.272 grams of inhibitor composition per square foot on 40 pound Kraft was just as effective as a corrosion inhibitor for packaged ferrous metal products as the conventional packaging materials having an inhibitor loading of 1.512 to 3.024 grams per square foot of sheet area.

Therefore, as this invention is now employed in commercial production of corrosion inhibiting sheet materials, the before mentioned inhibitor composition is applied to the sheet material by printing the composition in a pattern of uniformly spaced shapes of a size that the total area of the shapes will occupy from 25 to 30% of each square foot of printed sheet area and carry a total inhibitor dried weight of about 0.2268 to 0.302 grams per square foot of the printed sheet area.

A PREFERRED EMBODIMENT OF THE INVENTION

For commercial production of the herein described invention, it is preferred that the corrosion inhibitor composition be substantially as before described, namely: 15 parts Urea, 15 parts Sodium Nitrite, 10 parts Sodium Benzoate and 60 parts water as a carrier medium. This material was applied to a web of natural kraft paper 40 inches wide, usually of 40 pound weight, by a conventional printing process wherein the density of the printed impression can be controlled to be relatively light. The application of this inhibitor was done in a printed pattern of circular shapes 1.59 inches in diameter and uniformly spaced apart so that 25 of them would occupy about 26.7% of each square foot of the printed sheet material and the printed impressions were made light enough so that the total dried weight of the 25 shapes was substantially 0.272 grams.

While corrosion inhibitor treated 40 pound natural kraft ferrous metal packaging material made as above described has proved to be very successful in comparison with conventionally made products, it will be understood that any conventional corrosion inhibitor (VCI) composition may be used in the above described manner and the applied weight of the inhibitor composition may be within the range of 0.2268 to 0.302 grams per square foot of printed sheet area to produce a resultant corrosion inhibitor treated packaging material having substantially the same comparative success as the preferred embodiment.

Sheet material of any kind having a practical use, such as packaging material of any kind, plastic sheets, foils and films, inhibitor treated as above described can be used successfully to inhibit corrosion of ferrous metal surfaces subject to exposure to water vapor.

The shapes comprising the printed pattern may be of any desired form, as a pattern of uniformly spaced company trademarks or a pattern comprising a company logo, provided that the sum total dried weight of the inhibitor material in each square foot of the printed sheet is within the preferred range of 0.2268 to 0.302 grams.

The carrier medium, while usually water, may be any suitable volatile fluid and the amount of carrier used should be sufficient to provide a composition suitable for use for printing purpose.

Although but one specific embodiment of this invention has been herein described, it will be understood that details of the described treatment process and the materials with which it may be used may be varied without departing from the spirit of the invention as defined by the following claims.

I claim:

1. In an article for inhibiting corrosion of ferrous metal surfaces, a sheet carrier over-printed with a pattern of uniformly spaced areas of predetermined size formed of a vapor phase corrosion inhibiting composition applied with a printed density such that the dried weight of the said composition contained on each square foot of the printed area of the carrier is within the range of 0.2268 to 0.302 grams and the pattern of uniformly spaced inhibitor printed area occupies about 25 to 30 percent of each square foot of the printed carrier.

2. An article according to claim 1 wherein the dried weight of the said composition contained by each square foot of the printed carrier is 0.272 grams.

3. An article according to claim 1 wherein the inhibitor printed spaced area pattern occupies substantially 26.7 percent of each square foot of the printed carrier.

4. An article according to claim 3 wherein the inhibitor printed spaced-area pattern is composed of solid shapes of any suitable kind.

* * * * *